US008746698B2

(12) United States Patent
Wendling

(10) Patent No.: US 8,746,698 B2
(45) Date of Patent: Jun. 10, 2014

(54) CASINO CHIP PUSHER

(71) Applicant: Morris Wendling, New Orleans, LA (US)

(72) Inventor: Morris Wendling, New Orleans, LA (US)

( * ) Notice: Subject to any disclaimer, the term of this patent is extended or adjusted under 35 U.S.C. 154(b) by 0 days.

(21) Appl. No.: 13/674,378

(22) Filed: Nov. 12, 2012

(65) Prior Publication Data

US 2014/0131942 A1 May 15, 2014

Related U.S. Application Data

(63) Continuation-in-part of application No. 12/799,236, filed on Apr. 21, 2010, now abandoned.

(51) Int. Cl.
*A63F 11/00* (2006.01)

(52) U.S. Cl.
CPC ..... *A63F 11/0002* (2013.01)
USPC ..... 273/148 R; 473/40

(58) Field of Classification Search
CPC ..... A63F 11/0002
USPC ..... 273/148 R, 274; 473/40
See application file for complete search history.

(56) References Cited

U.S. PATENT DOCUMENTS

| | | | |
|---|---|---|---|
| 333,703 | A | 1/1886 | Vobelsang |
| 515,890 | A | 3/1894 | Walrath |
| 797,675 | A | 8/1905 | Fletcher |
| 1,336,556 | A | 4/1920 | Ebeling |
| 1,891,130 | A | 5/1930 | Wilson |
| 2,239,391 | A | 4/1941 | William |
| D127,966 | S | 7/1941 | Markham |
| D137,064 | S | 9/1943 | Roberts |
| 3,014,726 | A | 12/1961 | Angelier |
| 3,149,840 | A | 9/1964 | Swanson |
| 4,602,401 | A | 7/1986 | Holroyd |
| 4,872,688 | A | 10/1989 | Galvin |
| 4,988,005 | A | 1/1991 | Graham |
| 6,116,999 | A | 9/2000 | Montross |
| 6,893,017 | B1 | 5/2005 | Thomas et al. |
| 7,585,004 | B1 | 9/2009 | Page |
| 7,785,255 | B2 | 8/2010 | Malkani |
| 7,878,929 | B2 | 2/2011 | Perry-Smith |
| 8,075,030 | B2 | 12/2011 | Pearson et al. |
| 2002/0130522 | A1 | 9/2002 | Asazuma |

*Primary Examiner* — William Pierce
(74) *Attorney, Agent, or Firm* — Keaty Law Firm, LLC

(57) ABSTRACT

A casino chip organizer/pusher has a chip receiving portion and a handle secured to a lower end of the chip receiving portion. The chip-receiving portion is formed by a U-shaped fixed member affixed to the handle and an optional detachable U-shaped member that can be slidably engaged with the fixed member. When stacks of chips are positioned inside the chip receiving portion they can be transferred along the gaming table without tumbling.

23 Claims, 3 Drawing Sheets

CASINO CHIP PUSHER

CROSS-REFERENCE TO RELATED APPLICATIONS

This application is a continuation-in-part of my co-pending application Ser. No. 12/799,236 filed on Apr. 10, 2010 entitled "Casino chip organizer/pusher," the full disclosure of which is incorporated by reference herein and priority of which is hereby claimed.

BACKGROUND OF THE INVENTION

This invention relates to the field of casino management, and more particularly to a device whereby casino chips can be moved across the table from a dealer to the players in an expeditious manner.

Many casinos incorporate a variety of gaming tables where players can play blackjack, poker games, roulette and other. Most of the modern casinos use chips as currency equivalents. The chips are conventionally stored in special trays, positioned near the dealer or croupier. The dealer can remove the chips as the game requires and move them to a player. The dealer also collects the chips from players, exchanging currency for chips, while storing of the chips in the tray.

Conventional chip trays are divided into several compartments, each adapted to retain twenty chips, which can be of a singular or various denominations. Depending on the number of players and the magnitude of their game wages, the value of the chip bank set in the table chip tray at any given time changes as the game progresses. The chips are moved across the table by players and by the dealer with every bet. The dealer usually transfers a stack of chips between the players, between the tray and the table multiple times during the shift or operational period of the table game.

Most often, the chips are transferred by hand in small stacks of 20 to allow for easy counting of the chips. Should the stacks tumble on the table the dealer is required to place them in a stack again. The restacking is time consuming and labor intensive. Besides, restacking tends to interrupt the rhythm of the game. An additional complication is that the stacks of chips tend to disassemble and tumble when the direction of force of moving the chips is incorrect.

Some tables use elongated L-shaped sticks that move the dice and/or chips around the table. However, dealers are still required to stack the chip bank to allow for easy counting and subsequent dispensing. Some larger game tables are known to use a large organizer/pusher for delivering the chips to a winning better. However, such organizer/pushers are nothing more than a polished board and the chips have a tendency to slide off them.

Accordingly it would be beneficial to have the ability to move the chips across the table, between the dealer and the players, while the chips are in a stacked position and in a manner that would prevent tumbling and allow easy counting of the chips so as to increase accuracy, controllability, accessibility, simplicity and speed of game management.

SUMMARY OF THE INVENTION

It is, therefore, an object of the present invention to provide a casino chip delivery device for use at a gaming table.

It is another object of the invention to provide a device for delivering stacks of chips to the players at a gaming table.

It is a further object of the invention to provide a device that facilitates accuracy of counting of the chips delivered to the player at a gaming table.

These and other objects of the present invention are achieved through a provision of a casino chip device for transferring chips across a gaming table. The organizer/pusher device has a handle member configured to be manually engaged by a user. In one aspect, the handle member is an elongated member having a planar top surface. The organizer/pusher also comprises a chip-receiving portion secured to a lower distant part of the handle member. The chip receiving portion is formed by upwardly extending walls having sufficient height to accommodate, for instance, stacks of twenty standard chips.

The chip-receiving portion comprises a fixed member affixed to the handle and an optional detachable member detachably securable to the fixed member. In one aspect of the invention, the fixed member is formed by a generally U-shaped portion, and the detachable member is formed by a substantially U-shaped portion, which may have the same radius of curvature along its arcuate part as that of the fixed portion. When engaged together, the fixed portion and the detachable portion form the chip receiving portion that resembles a three-dimensional rhombus.

A pair of horizontal reinforcing plates is secured along a lower part of the wall sections of the fixed member, and a vertical support buttresses the vertical wall sections being secured on the exterior of the fixed member. In the preferred embodiment, the horizontal reinforcing plates extend in a co-planar relationship to the bottom surface of the vertical walls and the handle, allowing to smoothly slide the device along the gaming table.

BRIEF DESCRIPTION OF THE DRAWINGS

Reference will not be made to the drawings, wherein like parts are designated by like numerals, and wherein.

DETAILED DESCRIPTION OF THE INVENTION

Figure 1:
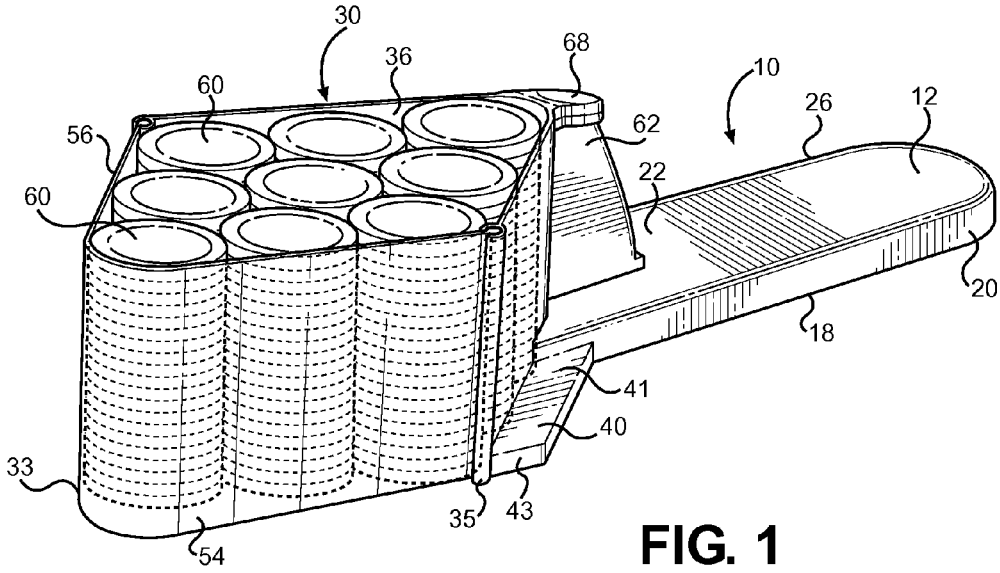
FIG. 1 is a perspective view of the casino chips organizer/pusher according to the present invention in an operational position.
Figure 2:
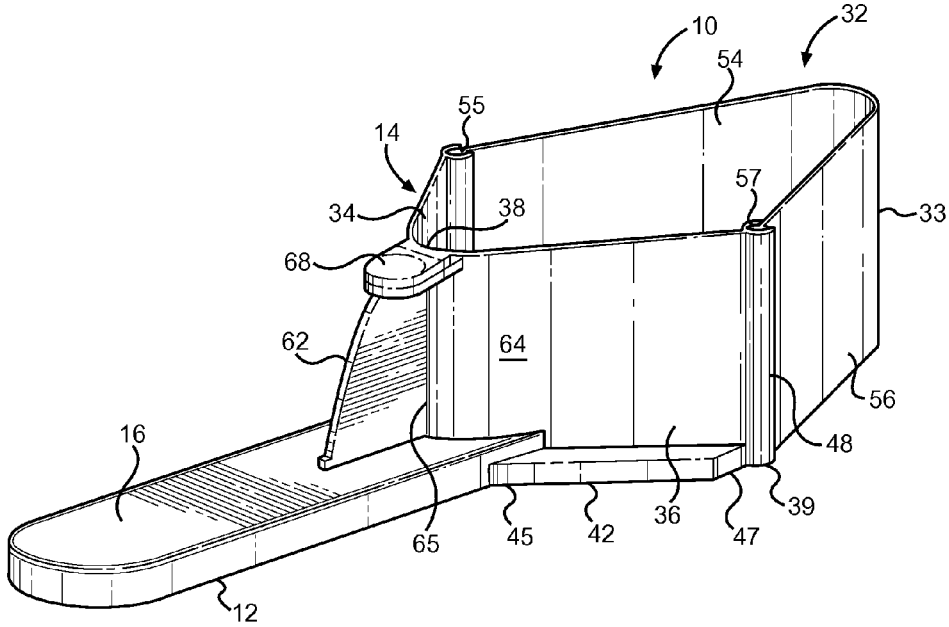
FIG. 2 is a perspective view of the casino chips organizer/pusher of the present invention without chips.

Turning now to the drawings in more detail, numeral 10 designates the casino chip organizer/pusher in accordance with the present invention. The organizer/pusher device 10 comprises an elongated handle 12 and a chip-receiving portion 14 secured to the handle 12. The handle 12 has a planar upper surface 16, a bottom surface 18, a distant end 20 and a proximate end 22.

The chip-receiving organizer/pusher portion 14 comprises a fixed vertically oriented generally U-shaped member 30 and a detachable U-shaped member 32. Depending on the number of stacks of chips being pushed, the detachable member 32 may or may not be used during a particular game round. The bottom of the chip-receiving portion 14 extends in a co-planar relationship to the bottom surface 18 of the handle 12.

The fixed member 30 comprises of a first wall section 34, a second wall section 36 and connecting middle wall section 38 disposed between the first wall section and the second wall section. As can be seen in the drawings, the connecting wall section 38 can be arcuate in cross section or can have a planar configuration similar to the wall sections 34 and 36. The interior surfaces of the first wall section 34, the second wall section 36, and the middle wall section 38 are formed protrusion free. The inner surfaces of the wall sections 34, 36 and 38 form a continuous obstruction-free inner wall surface of the fixed member 30.

The proximate end 22 of the handle 12 conforms to the shape of the middle wall section 38 and the wall sections 34, 36 along contact surfaces with the wall sections of the fixed chip receiving member 30. The handle 12 is secured to the lower parts of the first wall section 34, the middle wall section 38, and the second wall section 36. The bottom surface 18 of the handle 12 is smooth allowing easy sliding of the handle along the gaming table.

The fixed member 30 extends vertically upwardly from the proximate end 22 of the handle 12. The normal plane of the planar wall sections 34, 36 and the middle section 38 is oriented transversely to the plane of the handle 12.

A first horizontal reinforcement plate 40 is secured between a lower part of the outer surface of the first wall section 34 and the proximate end 22 of the handle 12. The first reinforcement plate 40 extends along the lower part of the first wall section 34, with the first end 41 of the reinforcement plate being in contact with the proximate end 22 of the handle 12 and its second end 43—adjacent a vertical edge 35 of the first wall section 34.

Figure 3:
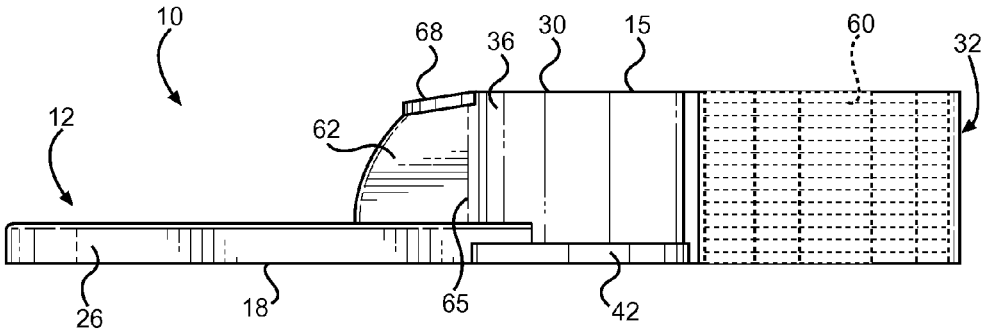
FIG. 3 is a side view of the casino chip organizer/pusher of the present invention showing stacks of twenty chips to be moved by the organizer/pusher device.

A second horizontal reinforcement plate 42 is configured to extend along the second wall section 36, with the first end 45 of the reinforcement plate 42 being attached to the proximate end 22 of the handle 12, and the second end 47 being adjacent a vertical edge 39 of the second wall section 36. The horizontal reinforcement plates 40 and 42 each have a flat smooth bottom surface extending substantially in a coplanar relationship to the bottom surface 18 of the handle 12 (see FIG. 3), allowing the organizer/pusher to smoothly slide on the felt 100 of a gaming table.

The vertical edges 35 and 39 are each provided with a continuously unitary formed engagement element 48 and 49, respectively. The engagement elements 48, 49 can be formed as cylindrical extensions of the vertical edges 35, 39 or can be defined by bent extensions of the vertical edges 35, 39. A vertical slit 50 is formed in the engagement element 48, and a similar vertical slit 52 is formed in the engagement element 49. The engagement elements 48, 49 have substantially the same height as the height of the wall sections 34 and 36, respectively. The vertical slits 50, 52 extend along entire height of the engagement elements 48, 49.

The detachable member 32 comprises a first part 54 and a second part 56 unitary connected to the first part 54 by a middle part 33. The first part 54 has a height which is substantially equal to the height of the wall section 34; the second part 56 has a height which is substantially equal to the height of the wall section 36.

The first part 54 of the detachable member 32 has a vertical edge 55, which is configured and arranged to slidably engage within the slit 52 of the engagement element 49. The second part 56 of the detachable member 32 has a vertical edge 57, which is configured and arranged to slidably engage within the slit 50 of the engagement element 48.

When engaging the detachable member 32 with the fixed member 30, the user lowers the detachable member over the fixed member 30, while aligning the vertical edges 55, 57 with the engagement elements 49, 48 and slidably fits the free vertical edges 55, 57 into the slits of the engagement elements 48, 49.

As can be seen in the drawings, the chip-receiving portion 14 assumes a general configuration of three-dimensional rhombus when the detachable member 32 is engaged with the fixed member 30. In this position, the wall section 34 extends substantially parallel to the part 56 and the wall section 36 extends substantially parallel to the wall section 54. The middle part 33 connecting the wall parts 54 and 56 is oriented opposite the middle wall section 38 when the members 30 and 32 are engaged.

Figure 4:
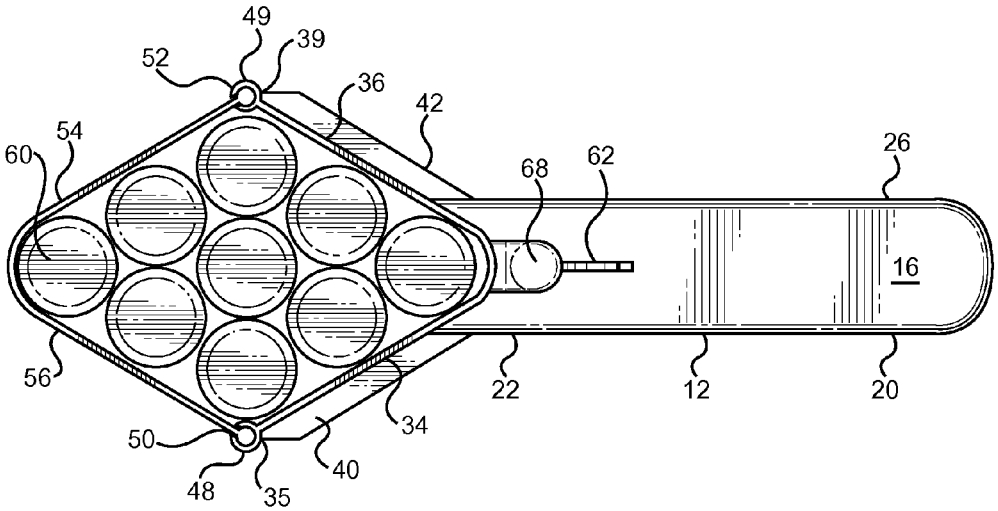
FIG. 4 is a top view of the casino chip organizer/pusher of the present invention with the stacks of chips engaged therewith.
Figure 5:
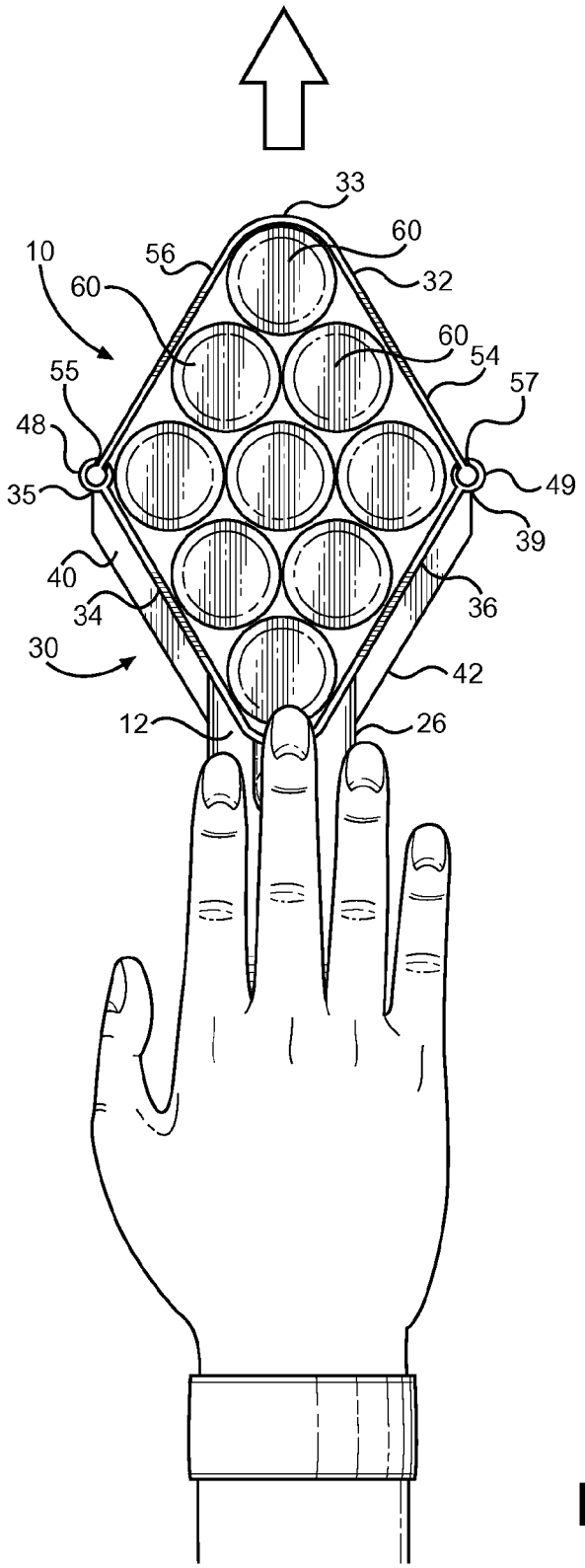
FIG. 5 illustrates a method of easily identifying the correct number of chips in the stack within the device of the present invention.

It is envisioned that the detachable member 32 will be particularly useful when the dealer has to push a large number of the stacks of chips, as shown in FIGS. 1, 4, and 5 across the gaming table. The multiple stacks of chips 60 can be fitted between the fixed member 30 and the detachable member 32 and moved across the table without worrying that the stacks will tumble.

A vertical support member 62 is secured to an exterior surface 64 of the middle wall section 38 and rests on the top surface 16 of the handle 12. The vertical support member 62 acts as a buttress for the upwardly extending wall sections 34, 36 and 38; it is disposed to absorb some of the forces acting on the walls as the organizer/pusher 10 is used to move the chips along the table surface. The vertical support member 62 comprises a planar body having a vertical edge 65, which is attached to the middle wall section 38 of the fixed member 30. The vertical dimensions of the vertical support member 62 approximate the vertical dimensions of the middle wall section 38.

A finger rest plate 68 is secured on top of the vertical support member 62 extending transversely to the vertical plane of the vertical support member 62. In one aspect of the invention, the finger rest 68 extends parallel to the top surface 16 of the handle 12. An upper surface 69 of the finger rest 68 is substantially aligned with the top edge of the middle wall section 38. The height of the top 15 edge of the wall sections 34, 36, and 38 and the wall parts 54, 56 is selected to be substantially even with the top chips in a stack of twenty chips. In this manner, the dealer sliding his/her finger along the finger rest plate 68 and the top chips in the stacks 60 can easily determine whether the stacks of chips have twenty chips each, less than twenty chips or more than twenty chips.

If desired, the finger rest 68 can be provided with an indentation and a peripheral lip. It will be understood that the indentation and the lip are optional features of the device and may be omitted in some embodiments.

As can be seen in the drawings, the wall sections 34 and 36 extend at an acute angle in relation to each other diverging in opposite directions from the middle wall section 38. A chip-receiving channel is formed between the inner surfaces of the wall sections 34, 36 and the inner surface of the middle wall section 38. A chip-receiving channel is also formed between the inner surfaces of the parts 33, 54, and 56 of the detachable member 32.

Standard casino chips are about 39 millimeters in diameters and 3.4 millimeters in thickness. The chips can be made of clay, ceramics, molded material, etc. The height of the chip receiving members 30 and 32 is selected to be almost identical to the height of a 20-chip stack. Therefore, when the chips are stacked in 20-chip stacks, such as shown in FIGS. 1, 3-5, none of the properly stacked chips will protrude above the top edge 15 of the chip-receiving portion 14. The dealer can easily identify whether the stack contains the pre-determined number of chips by moving his hand across the top of the chip stack.

However if the counting was incorrectly performed and more than the predetermined number of chips (in this example twenty) are stacked in one stack 60, the dealer can identify the extra chips from the stack. The extra chips can be removed from the stacks 60 and put back in the tray.

Similarly, if the stack 60 has fewer than twenty chips, the dealer can easily identify such stack and add chips to the small stack. The missing number of chips can be easily identified by either running the hand over the stacks or visually observing other stacks which are below the top edge 15 of the organizer/pusher walls. The dealer can add the chips to the stacks 60 and make the stacks even in the number of chips within each stack.

It is envisioned that multiple chip stacks can be moved with the organizer/pusher 10. In the exemplary illustrations, the organizer/pusher 10 is used to move nine stacks of chips across the table. Of course, the number of stacks can vary from one to several, depending on the winnings of the player or on the number of chips purchased by the player from the dealer.

The height of the chip-receiving portion 14 can be easily modified for the chips having different thickness or the desired number of chips in a stack. It is acknowledged that some of the chips may have a diameter of 4 centimeters as opposed to the standard diameter of 39 mm and have a different thickness, for instance 0.3 cm. Nevertheless, the minor adjustments in the height of the walls can be easily made to accommodate various heights, thickness, and diameter of the chips.

The length of the handle 12 can be selected by the organizer/pusher manufacturer or a casino. It is envisioned that some embodiments may have handles that are shorter and some longer than the length of the chip-receiving portion 14. Any ergonomic adjustments in the construction of the handle are within the scope of this invention.

The handle and the chip-receiving portion can be made of any desired material strong enough to withstand repeated sliding across a gaming table. Without limitation, such material can be wood, plastic, aluminum, etc. It is envisioned that the chip receiving portion can be made circular, oval, square, etc. depending on the type of stacks of chips being transferred across the table.

Many other changes and modifications can be made in the design of the present invention without departing from the spirit thereof. I therefore request that my rights to the present invention be limited only by the scope of the appended claims.

The invention claimed is:

1. A casino chip organizer/pusher device for transferring chips across a gaming table, comprising:

a handle member having a proximate end and a distant end and arranged to be manually engaged by a user; and a chip-receiving portion having a lower part secured to one end of the handle member and extending upwardly therefrom, the handle member and the chip receiving portion being disposed to slide the chips across the gaming table, said chip-receiving portion comprising a fixed member having a lower part secured to the handle member and a detachable member detachably securable to the fixed member, said fixed member and said detachable member forming a three-dimensional rhombus when engaged together.

2. A casino chip organizer/pusher device for transferring chips across a gaming table, comprising:

a handle member having a proximate end and a distant end and arranged to be manually engaged by a user; and a chip-receiving portion having a lower part secured to one end of the handle member and extending upwardly therefrom, the handle member and the chip receiving portion being, said fixed member having a generally U-shaped configuration and said detachable member having a generally U-shaped configuration.

3. The device of claim 1, said fixed member comprises a pair of vertical walls oriented at an acute angle in relation to each other, wherein free edges of the vertical walls each carry an engagement element.

4. A casino chip organizer/pusher device for transferring chips across a gaming table, comprising:

a handle member having a proximate end and a distant end and arranged to be manually engaged by a user; and a chip-receiving portion having a lower part secured to one end of the handle member and extending upwardly therefrom, the handle member and the chip receiving portion being disposed to slide the chips across the gaming table, said chip-receiving portion comprising a fixed member having a lower part secured to the handle member and a detachable member detachably securable to the fixed member, wherein the detachable member comprises a pair of vertically extending parts oriented at an acute angle in relation to each other, and wherein free edges of the vertically extending parts are arranged to slidably engage with the engagement elements of the fixed member.

5. The device of claim 1, said handle and said chip-receiving portion having bottom surfaces disposed for sliding across a gaming table.

6. The device of claim 1, wherein said chip-receiving portion has a predetermined vertical dimension selected to be substantially equal to a height of a stack of pre-selected number of chips.

7. The device of claim 1, wherein said chip-receiving portion comprises a pair of vertically-oriented wall sections oriented at an acute angle in relation to each other and transversely to the handle member, said vertically-oriented wall sections defining a chip receiving channel.

8. The device of claim 7, wherein each of said pair of wall sections is secured along one of its vertical edges to a vertically-extending middle wall section, and wherein the handle member has a distant end secured to a lower end of said middle wall section, said middle wall section having similar vertical dimensions as each of the pair of vertically-oriented wall sections.

9. The device of claim 8, further comprising a vertical support member secured to an exterior surface of the middle wall section and resting on the distant end of the handle member, said vertical support member extending substantially along entire height of the middle wall section.

10. The device of claim 9, wherein said vertical support member extends transversely to a normal axis of the handle member.

11. The device of claim 9, wherein a finger rest member is mounted on top of the vertical support member and extending transversely to a vertical plane of the vertical support member without extending above an upper edge of the middle wall section.

12. The device of claim 7, further comprising a pair of horizontal reinforcement plates, each horizontal reinforcement plate extending along a lower part of a corresponding vertically oriented wall section and secured to the distant end of the handle member.

13. The device of claim 12, wherein said handle member has a flat bottom surface, said reinforcement plates each have a flat bottom surface, and wherein the bottom surfaces of the handle member and the reinforcement plates extend in a substantially coplanar relationship to facilitate sliding of the device along a gaming table.

14. A casino chip organizer/pusher device for transferring chips across a gaming table, comprising:

a handle member having a proximate end and a distant end and configured to be manually engaged by a user; and a chip-receiving portion having a lower part secured to the distant one end of the handle member and extending upwardly therefrom, said chip-receiving portion comprising a fixed member and a detachable member detachably securable to the fixed member to define a chip-receiving channel, the handle member and the chip receiving portion being arranged to transfer chips across the gaming table, said fixed member having a generally U-shaped configuration and said detachable member having a generally U-shaped configuration.

15. The device of claim 14, said fixed member comprises a pair of vertical walls oriented at an acute angle in relation to each other and connected by a continuously unitary connected vertically oriented middle wall section, wherein free edges of the pair of vertical walls each carry an engagement element.

16. The device of claim 15, the detachable member comprises a pair of vertically extending parts oriented at an acute angle in relation to each other, wherein free edges of the vertically extending parts are arranged to slidably engage with the engagement elements of the fixed member.

17. A casino chip organizer/pusher device for transferring chips across a gaming table, comprising:

a handle member having a proximate end and a distant end and configured to be manually engaged by a user; and a chip-receiving portion having a lower part secured to the distant one end of the handle member and extending upwardly therefrom, said chip-receiving portion comprising a fixed member and a detachable member detachably securable to the fixed member to define a chip-receiving channel, the handle member and the chip receiving portion being arranged to transfer chips across the gaming table, said fixed member comprises a pair of vertical walls oriented at an acute angle in relation to each other and connected by a continuously unitary connected vertically oriented middle wall section, wherein free edges of the pair of vertical walls each carry an engagement element, the detachable member comprises a pair of vertically extending parts oriented at an acute angle in relation to each other, wherein free edges of the vertically extending parts are arranged to slidably engage with the engagement elements of the fixed member, and wherein said pair of the vertical walls and the middle wall section form a continuous wall having a protrusion free inner surface, and wherein a lower end of said middle wall section is affixed to the distant end of the handle member, said middle wall section having similar vertical dimensions as each of the pair of vertically-oriented wall sections.

18. The device of claim 17, wherein a horizontal reinforcement plate is secured along a lower part of each of the vertically oriented walls and secured to the distant end of the handle member.

19. The device of claim 18, wherein said handle member has a flat bottom surface, said reinforcement plates each have a flat bottom surface, and wherein the bottom surfaces of the handle member and the reinforcement plates extend in a substantially coplanar relationship to facilitate sliding of the device along a gaming table.

20. The device of claim 17, wherein a vertical support member is secured to an exterior surface of the middle wall section and rests on the distant end of the handle member, said vertical support member buttressing the vertical wall.

21. The device of claim 20, wherein said vertical support member is configured to extend transversely to a normal axis of the handle member, said vertical support member extending substantially along entire height of the middle wall section.

22. The device of claim 20, wherein a finger rest member is mounted on top of the vertical support member without extending transversely to the vertical support member and above an upper edge of the middle wall section.

23. The device of claim 17, wherein said chip-receiving portion has a predetermined vertical dimension selected to be substantially equal to a height of a stack of pre-selected number of chips.

* * * * *